United States Patent [19]

Woolf

[11] Patent Number: 4,620,767

[45] Date of Patent: Nov. 4, 1986

[54] COMBINATION BATTERY BOOSTER CABLE CONNECTOR

[75] Inventor: Harold L. Woolf, Philadelphia, Pa.

[73] Assignee: East Penn Manufacturing Co., Inc., Lyon Station, Pa.

[21] Appl. No.: 703,727

[22] Filed: Feb. 21, 1985

[51] Int. Cl.[4] ..... H01R 11/22

[52] U.S. Cl. ..... 339/255 P; 339/29 B; 339/32 R; 339/224; 339/261

[58] Field of Search ..... 339/29 B, 224, 255 P, 339/261, 32, 33

[56] References Cited

U.S. PATENT DOCUMENTS 4,345,807 8/1982 Shekel et al. .
4,373,762 2/1983 Shekel et al. .
4,373,763 2/1983 Shekel et al. .
4,377,317 3/1983 Shekel et al. ..... 339/29 B
4,449,772 5/1984 Johnson, III ..... 339/33
4,453,791 6/1984 Ledbetter .
4,488,147 12/1984 Signorile ..... 339/29 B

*Primary Examiner*—Joseph H. McGlynn
*Attorney, Agent, or Firm*—Z. T. Wobensmith, III

[57] ABSTRACT

A combination battery booster cable connector for both top and side terminal batteries for connecting battery cables, which includes a pair of hinged clamp halves, which are resiliently urged together, and have jaws formed adjacent each end, to engage a top battery terminal when in closed engaged position. The connector has portions extending forwardly from the jaws on one side for engaging the side terminal bolt of a side terminal battery.

4 Claims, 5 Drawing Figures

COMBINATION BATTERY BOOSTER CABLE CONNECTOR

BACKGROUND OF THE INVENTION

1. Field of the Invention

This invention relates to battery booster cable connectors of the type which can be used with both top and side terminal batteries.

2. DESCRIPTION OF THE PRIOR ART

In recent years many automobile manufacturers have changed from using batteries with top terminals to using batteries with side terminals, with the results that both types of batteries are now in use.

Accordingly, one who wants to connect the battery on his car to another battery by using booster cables, may be faced with a different type of battery to which his battery booster cables can not be connected. Cable connection to the side terminal bolts of side terminal batteries is often difficult, as the terminal bolts do not project more than slightly from the side walls of the battery, and are often close to the fender panel or other grounded metal surface, which makes attachment thereto difficult and fraught with some degree of danger.

Various connectors have been proposed for use with booster cables for both top and side terminal batteries among which are the Shekel U.S. Pat. Nos. 4,345,807; 4,373,762; 4,373,763; 4,377,317, which disclose connectors with jaws to grip a top terminal battery in the conventional manner, and with a swing out adapter to grip a side terminal battery. The adapters merely snap on the side terminal which requires a uniformity of size of terminal bolts and which can result in arcing and/or poor contact between the connector and side terminal, and which suffer from other shortcomings.

The Johnson, III U.S. Pat. No. 4,449,772 discloses an electrical connector for top and side mount battery terminals, with conventional clamp ends to contact a top terminal battery, and with an elongated fork shaped slot in one of the jaws to snap over the side mount terminal, and with a contact surface on the other jaw to clamp the terminal therebetween. The Johnson structure also suffers from the shortcomings previously described for the Shekel patents.

The Ledbetter U.S. Pat. No. 4,453,791 discloses a structure similar to Johnson for clamping of top mount terminal batteries, and has a closed slot 52 for engaging side terminal mount batteries. This structure also suffers from the shortcomings previously described.

The combination battery booster cable connector of the invention provides for positive connection of the connector to both top and side terminal batteries, without the shortcomings of previously available connectors.

SUMMARY OF THE INVENTION

The invention relates to a combination battery booster cable connector, that can be used with both top and side terminal batteries, that includes a pair of hinged opposed resiliently urged clamp halves, with jaws thereon to connect to a top mount battery terminal, and with clamping portions to engage a side mount battery terminal bolt.

The principal object of the invention is to provide a combination battery booster cable connector that can be interchangeably used with both top and side terminal batteries.

A further object of the invention is to provide a connector of the character aforesaid that is positive in operation and provides a high degree of safety.

A further object of the invention is to provide a connector of the character aforesaid that is simple to construct and has a long service life.

A further object of the invention is to provide a connector of the character aforesaid that is simple to use.

A further object of the invention is to provide a connector of the character aforesaid that can be used with a variety of sizes of batteries and battery cables.

Other objects and advantageous features of the invention will be apparent from the description and claims.

DESCRIPTION OF THE DRAWINGS

The nature and characteristic features of the invention will be more readily understood from the following description taken in connection with the accompanying drawings forming part hereof in which.

Figure 1:
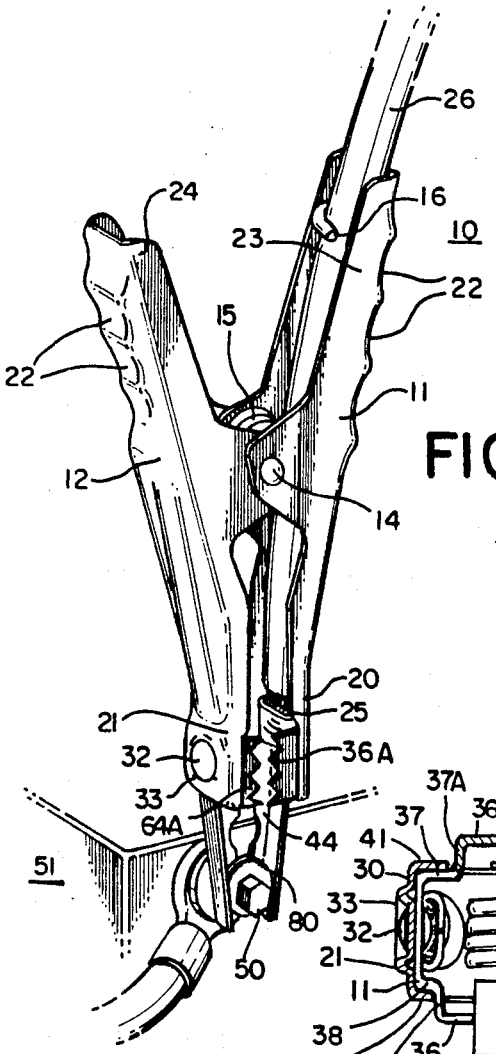
FIG. 1 is a view in perspective illustrating the combination battery cable connector attached to a typical side terminal battery.

It should, of course, be understood that the description and drawings herein are illustrative merely and that various modifications and changes can be made in the structure disclosed without departing from the spirit of the invention.

Like numerals refer to like parts throughout the several views.

DESCRIPTION OF THE PREFERRED EMBODIMENT

Referring now more particularly to the drawings and FIGS. 1 to 5 thereof, the combination battery booster cable connector 10 as illustrated therein includes a pair of opposed clamp halves 11 and 12.

The clamp halves 11 and 12 are hingedly secured together by a rivet 14, which carries a conventional coiled spring 15 thereon, which has ends 16 and 17, which respectively bear on the inner surfaces 18 and 19 of clamp halves 11 and 12 urging them together at the respective ends 20 and 21. The clamp halves 11 and 12 are of generally elongated rectangular configuration with indentations 22 at the rear ends 23 and 24 opposite to ends 20 and 21, for gripping by the hands and fingers of a user (not shown).

The clamp halve 11 has the exposed metallic cable portion 25 of a battery cable 26 engaged in a crimped flange 27, in conventional manner, to obtain an electrical connection thereto. The clamp halves 11 and 12 may be constructed of metal or electrically insulating synthetic plastic, and in the embodiment shown herein are formed of metal with a suitable insulating coating 30 thereon. The flange 27 is part of a member 31 which is attached to clamp halve 11 by a rivet 32, which rivet is contained in a dimpled recess 33, below the normal surface 34 of the clamp halve 11.

The member 31 which is of metal, has a central plate 35 through which the rivet 32 extends, and has a pair of jaws 36 and 36A connected thereto perpendicular to plate 35 by intermediate plates 37 and 37*a*, and 38 and 38A, which jaws 36 and 36A have a plurality of spaced gripping teeth 40 extending therefrom.

It should be noted that the jaws 36 and 36A are spaced above the edges 41 and 42 of clamp halve 11.

The plates 37, and the jaw 36, has a gripping plate 44 extending therefrom, in the same plane as the jaw 36, with a plurality of notches 45 which grip a side terminal bolt 50 of a battery 51 as shown in FIG. 1. A stiffening plate 52 is also provided, which is intergral with and perpendicular to plate 41.

Referring now to clamp halve 12, a member 60 is provided, with a central plate 62, through which a rivet 63 extends for fastening to the clamp halve 12 in a dimpled recess 63A, similar to recess 33. The central plate 62 has a pair of jaws 64 and 64A connected thereto perpendicular to plate 62, by intermediate plates 65, 65A and 66, 66A and which jaws 64 and 64A have a plurality of spaced gripping teeth 68 extending therefrom. The jaws 64 and 64A are spaced above the edges 70 and 71 of the clamp halve 12, the same distance as jaws 36 and 36A are spaced above edges 41 and 42 of clamp halve 11.

A stop plate 75 is provided, connected to the rear of plate 62 and which is at an angle less than 90° to plate 62, and which contacts plate 35 in the closed position of cable connector 10.

The plate 65 and jaw 64 has a gripping plate 76 extending therefrom, in the same plane as jaw 64, with a plurality of notches 77 which grip the other side of the side terminal 50 from plate 45 of clamp halve 11 as shown in FIG. 1. The plate 76 also has a stiffening plate 78 integral therewith and perpendicular thereto as described for plate 52.

The mode of operation and use will now be described.

When it is desired to use the cable connector 10 in connection with a side terminal battery bolt 50, the clamp halves 11 and 12 are gripped by the hand of a user (not shown) at indentations 22 and forced together against the force of spring 15 to separate the ends 20 and 21. The gripping plates 45 and 76 are placed onto the rim 80 of side terminal bolt 50, at one of the opposed sets of notches 45 and 77, and the pressure released to permit the plates 45 and 76 to move together and grip the side terminal 50. When the operation is completed, the halves 11 and 12 are squeezed to move ends 20 and 21 apart, and the connector 10 removed.

Figure 3:
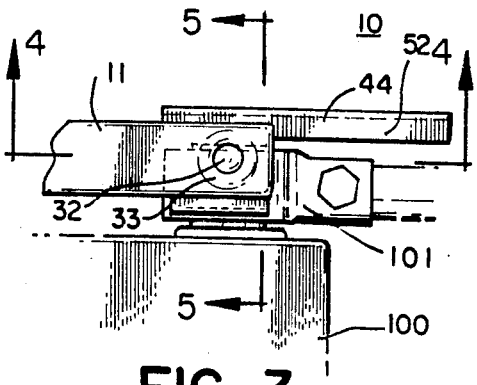
FIG. 3 is a fragmentary side elevational view of the combination battery cable connector engaged with a top terminal battery cable.
Figure 4:
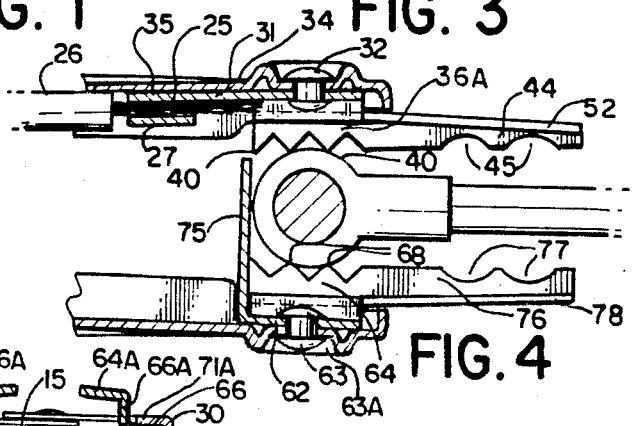
FIG. 4 is a horizontal sectional view, enlarged, taken approximately on the line 4—4 of FIG. 3.
Figure 5:
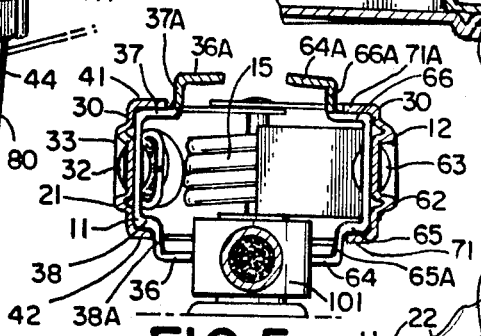
FIG. 5 is a vertical sectional view, enlarged, taken approximately on the line 5—5 of FIG. 3.
Figure 2:
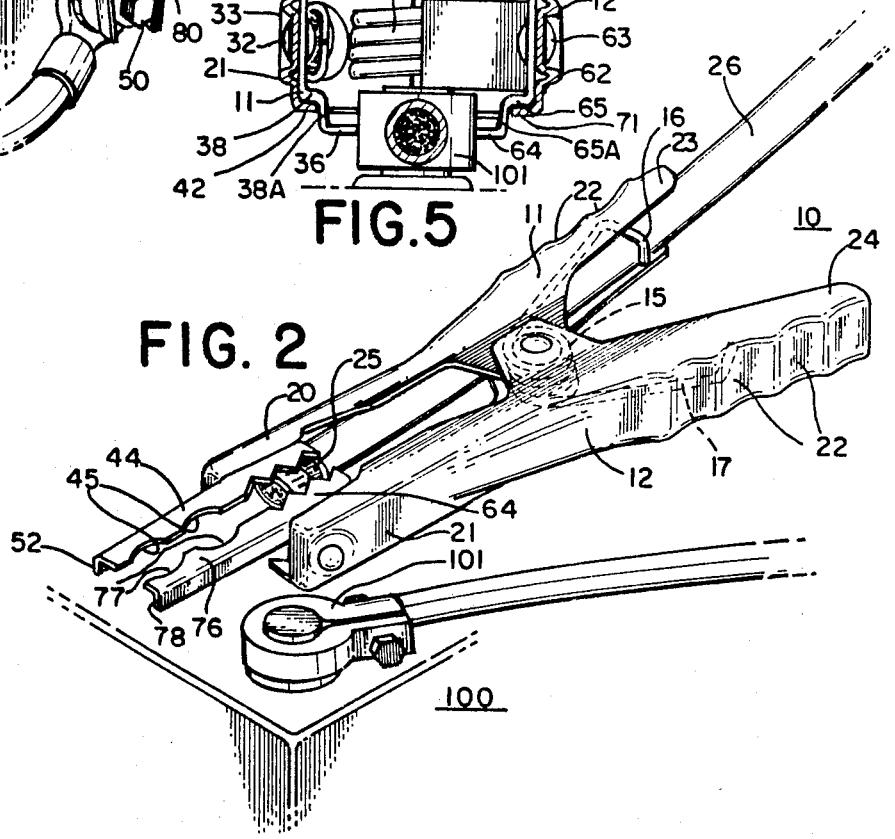
FIG. 2 is a view in perspective illustrating the combination battery cable connector just prior to engagement with a top terminal battery cable.

When it is desired to use the cable connector 10 on a top terminal battery 100, as shown in FIGS. 2 and 3, the clamp halves 11 and 12 are again grasped at the indentations 22 by the hand and fingers of a user (not shown) and the ends 20 and 21 forced apart against the force of the spring 15.

The jaws 36A and 64A are placed over the vehicle's battery cable terminal 101, and pressure on the clamp halves 11 and 12 released, so that ends 20 and 21 move together, and teeth 40 and 68 grip the terminal 101. When the operation is completed, the clamp halves 11 and 12 are squeezed to separate the ends 20 and 21, and the connector 10 removed.

The operation can continue as desired with use on either a side or top terminal battery or between side or top terminal batteries as desired.

It will thus be seen that a combination battery booster cable connector has been provided with which the objects of the invention are achieved.

I claim:

1. A combination battery booster cable connector for connection to a top terminal battery and a side terminal battery which comprises a pair of clamp halves hingedly secured together, said clamp halves having front and rear ends, resilient means carried by said halves urging said front ends of said clamp halves together, gripping means carried on said front ends of said clamp halves for gripping a side terminal bolt of a side terminal battery, said gripping means including a side terminal gripping plate carried by and extending forwardly from the front end of each of said clamp halves in opposing relation, said side terminal plates each having notches to engage a groove of said side terminal bolt in cooperating gripping engagement therebetween, means for gripping a battery cable terminal of a top terminal battery carried by said halves, said top terminal gripping means including a pair of opposed jaws extending from the front ends of said halves, for gripping engagement with said battery cable terminal.

2. A combustion battery booster cable connector as defined in claim 1 in which said clamp halves are hinged together by a rivet, and said resilient means is a coiled spring.

3. A combination battery booster cable connector as defined in claim 1 in which said top terminal gripping means and said side terminal gripping means are integral.

4. A combination battery booster cable connector as defined in claim 1 in which said clamp halves are provided with indentations at the rear ends for gripping by the hand and fingers of a user.

* * * * *

UNITED STATES PATENT AND TRADEMARK OFFICE

CERTIFICATE OF CORRECTION

PATENT NO. : 4,620,767

DATED : November 4, 1986

INVENTOR(S) : HAROLD L. WOOLF

It is certified that error appears in the above-identified patent and that said Letters Patent is hereby corrected as shown below:

Column 4,

Line 42, after "A" and before "battery", "combustion" should be -- combination --.

Signed and Sealed this

Twenty-seventh Day of January, 1987

*Attest:*

DONALD J. QUIGG

*Attesting Officer* *Commissioner of Patents and Trademarks*